US006877622B2

(12) United States Patent
Tsai

(10) Patent No.: US 6,877,622 B2
(45) Date of Patent: Apr. 12, 2005

(54) COLLAPSIBLE CLOSET FRAME

(76) Inventor: Tony Tsai, 4F-3, Fu Chin St., Song Shan Dist., Taipei (TW)

( * ) Notice: Subject to any disclaimer, the term of this patent is extended or adjusted under 35 U.S.C. 154(b) by 10 days.

(21) Appl. No.: 10/662,285

(22) Filed: Sep. 16, 2003

(65) Prior Publication Data

US 2005/0056606 A1 Mar. 17, 2005

(51) Int. Cl.[7] ..... A47B 47/00
(52) U.S. Cl. ..... 211/195; 211/201; 248/164
(58) Field of Search ..... 211/195, 201, 200; 135/131, 135/145, 157; 52/646; 248/150, 165, 163.1, 248/164, 431, 166, 167, 434, 435, 436

(56) References Cited

U.S. PATENT DOCUMENTS 2,985,316 A * 5/1961 Ruhnke ..... 211/201
3,235,038 A * 2/1966 Nesslinger ..... 182/62.5
5,005,896 A * 4/1991 Li ..... 296/100.18
5,123,665 A * 6/1992 Levy ..... 280/35
5,645,259 A * 7/1997 Chen ..... 248/436
6,502,597 B2 * 1/2003 Carter ..... 135/145
6,598,614 B2 * 7/2003 Liu ..... 135/131
6,601,599 B2 * 8/2003 Carter ..... 135/145
2002/0059948 A1 * 5/2002 Carter ..... 135/121
2003/0213513 A1 * 11/2003 Eriksen et al. ..... 135/131
2004/0050008 A1 * 3/2004 Mintie et al. ..... 52/646
2004/0163695 A1 * 8/2004 Carter ..... 135/131
2004/0173253 A1 * 9/2004 Carter ..... 135/131

* cited by examiner

*Primary Examiner*—Jennifer E. Novosad
(74) *Attorney, Agent, or Firm*—Rosenberg, Klein & Lee

(57) ABSTRACT

A collapsible closet frame includes pillars, posts, first linking rod sets, second linking rod sets, third linking rod sets. The pillars are located at four corners of the closet. The posts are connected to the pillars in a sliding manner. The first linking rod sets and the second linking rod sets are connected with the pillars while the third linking rod sets are connected with the first linking rod sets. The second linking rod sets comprise cross bars which are hooked to the third linking rod set. The closet frame is easy to collapse for carrying and storage.

6 Claims, 11 Drawing Sheets

COLLAPSIBLE CLOSET FRAME

FIELD OF THE INVENTION

This invention relates to a closet frame, and more particularly to a collapsible closet frame composed of pillars, posts, first lining rod sets, second linking rod sets and third linking rod sets, which is easy to storage and carry.

BACKGROUND OF THE INVENTION

Conventional closets are in fixed status, and mostly they come with the building's structure. There are some assembled closets on the market, however, these designs are connected piece by piece with tools, which not only consume time but also are complicated to new users.

SUMMARY OF THE INVENTION

It is the first object of the present invention to provide a collapsible closet frame, which is easy to expand and collapse.

It is another object of the present invention to provide a collapsible closet frame, which is compact when collapsed for carrying and storage purpose.

It is a further object of the present invention to provide a collapsible closet frame, which consumes less time in expanding and collapsing and is cost effectiveness.

DETAILED DESCRIPTION OF THE PREFERRED EMBODIMENT

Figure 1:
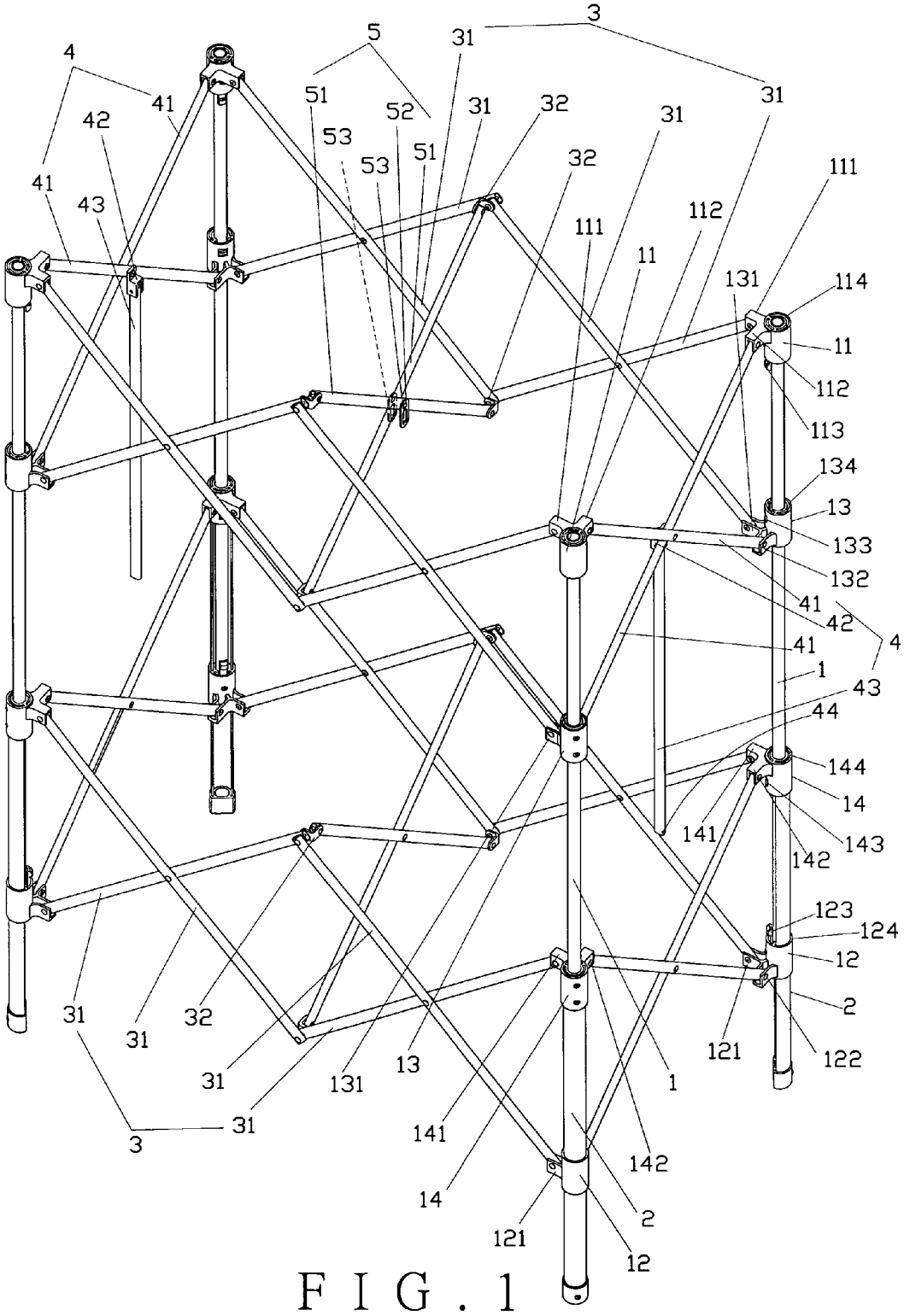
FIG. 1 is a perspective view of the present invention.

The collapsible closet frame, as shown in FIG. 1, comprises pillars 1, posts 2, first lining rod sets 3, second linking rod sets 4 and third linking rod sets 5.

Figure 2:
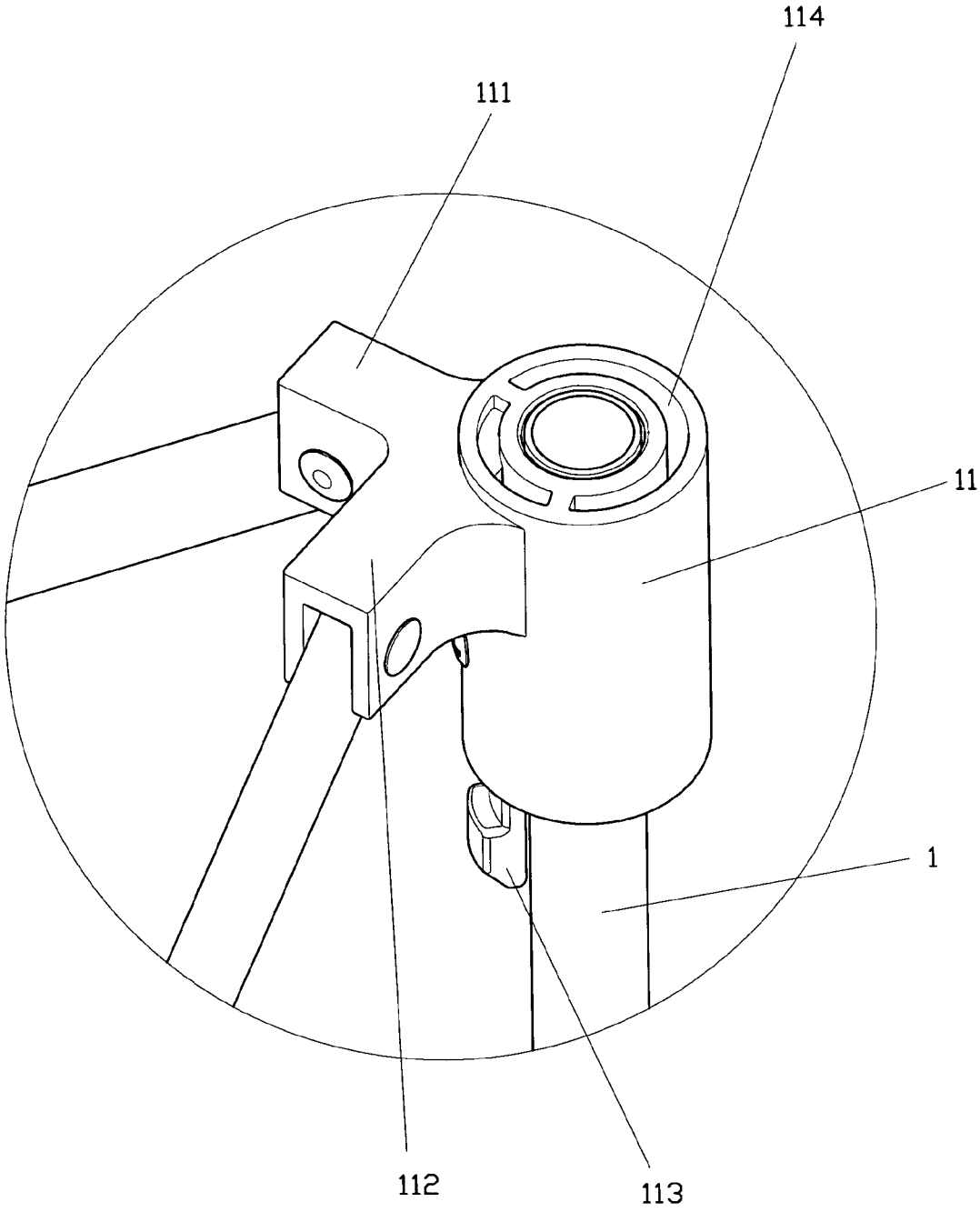
FIG. 2 is an enlarged view of a first bracket of the present invention.
Figure 3:
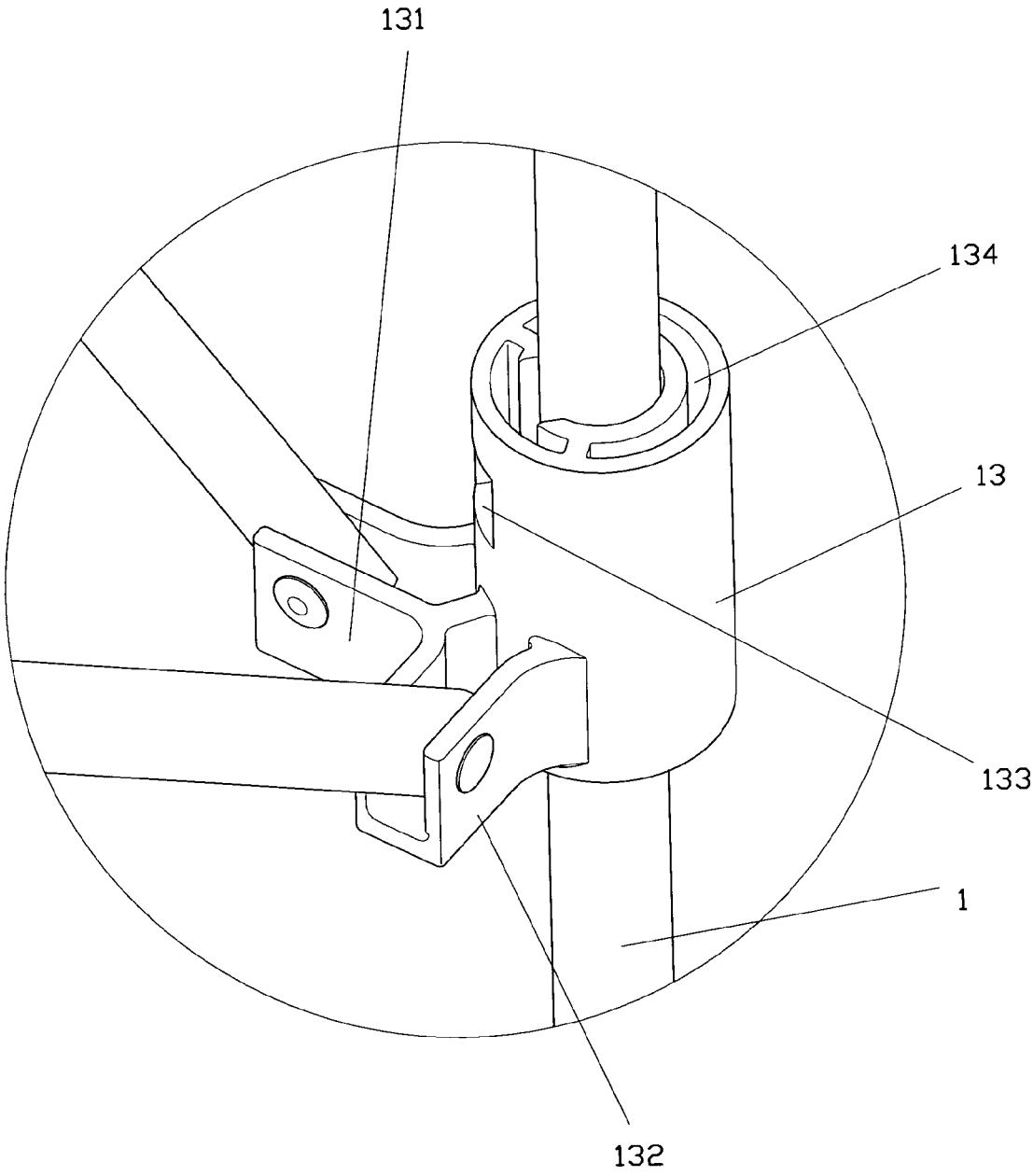
FIG. 3 is an enlarged view of a first sliding bracket of the present invention.

The pillars 1 are at four corners of the closet frame, and each is seated on a corresponding post 2. Wherein the top end of each pillar 1 is secured with a first bracket 11 and the bottom end of each pillar 1 is secured with a second bracket 12. A first sliding bracket 13 and a second sliding bracket 14 are set between the first bracket 11 and the second bracket 12. The first bracket 11 and the second bracket 12 are identical in structure, therefore, only one drawing is shown in FIG. 2. The first bracket 11 comprises a first connecting end 111, a second connecting end 112, a clip 113, and an arcuate groove 114. The second bracket 12 comprises a first connecting end 121, a second connecting end 122, a clip 123, and an arcuate groove 124. The first sliding bracket 13 and the second sliding bracket 14 are both identical in structure, and only one drawing is shown in FIG. 3. The first sliding bracket 13 comprises a first connecting end 131, a second connecting end 132, a hole 133, and an arcuate groove 134. The second sliding bracket 14 comprises a first connecting end 141, a second connecting end 142, a hole 143, and an arcuate groove 144.

Figure 4:
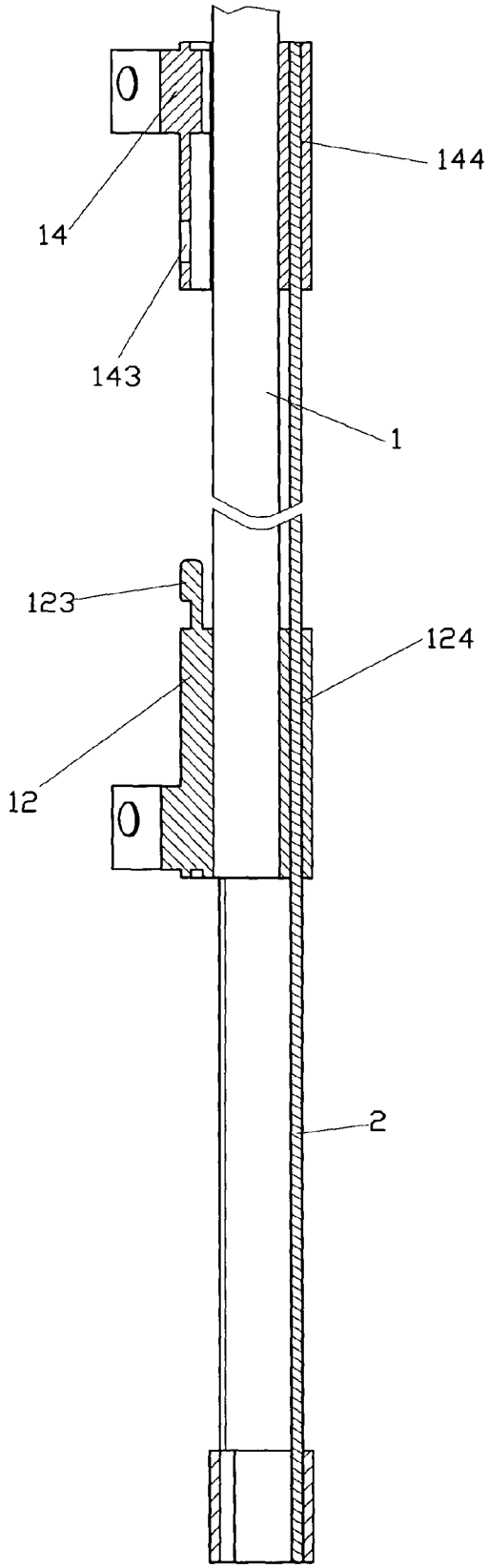
FIG. 4 is a cross sectional view of posts of the present invention.

Each of the posts 2, as shown in FIG. 4, is in an arcuate shape in order to slip into the arcuate groove 124 of the second bracket 12 which may slide along the post 2. The top end of the post 2 is securely connected to the second sliding bracket 14, and the pillar 1 is slipped into the second sliding bracket 14 in a sliding manner, thus the pillar 1 is able to expand or retract with respect to the post 2.

Each of the first linking rod sets 3 is formed with two rods 31 with the center portion connected with each other to form an X-shaped member. Every two X-shaped members are connected again to form a scissors-type structure. Each scissors-type structure has a first connecting end 32. There are four first linking rod sets 3 pivoted to both the upper and the lower ends of the pillars 1, and they are in an opposite position with each other. The first linking rod set 3 located at the upper ends between the two pillars 1 has their four ends pivoted to the first connecting end 111 of the first bracket 11 and the first connecting end 131 of the first sliding bracket 13. The first linking rod set 3 located at the lower ends between the two pillars 1 has their four ends pivoted to the first connecting end 121 of the second bracket 12 and the first connecting end 141 of the second sliding bracket 14.

Each of the second linking rod sets 4 is formed by two crossed rods 41 to form an X shape. The connection area of the two rods 41 has a second connecting end 42. There are four second linking rod sets 4 pivoted to both the upper and the lower ends between every two pillars 1. The second linking rod set 4 located on the upper ends of the pillars 1 has its four ends pivoted to the second connecting end 112 of the first bracket 11 and to the second connecting end 132 of the first sliding bracket 13, respectively, whereas the four ends of the second linking rod set 4 located on the lower ends of the pillars 1 are connected to the second connecting end 122 of the second bracket 12 and to the second connecting end 142 of the second sliding bracket 14, respectively. The second connecting end 42 of the second linking rod set 4 located on the upper ends of the pillars 1 is provided with a cross bar 43 with a hole 44 at one end thereof.

Figure 5:
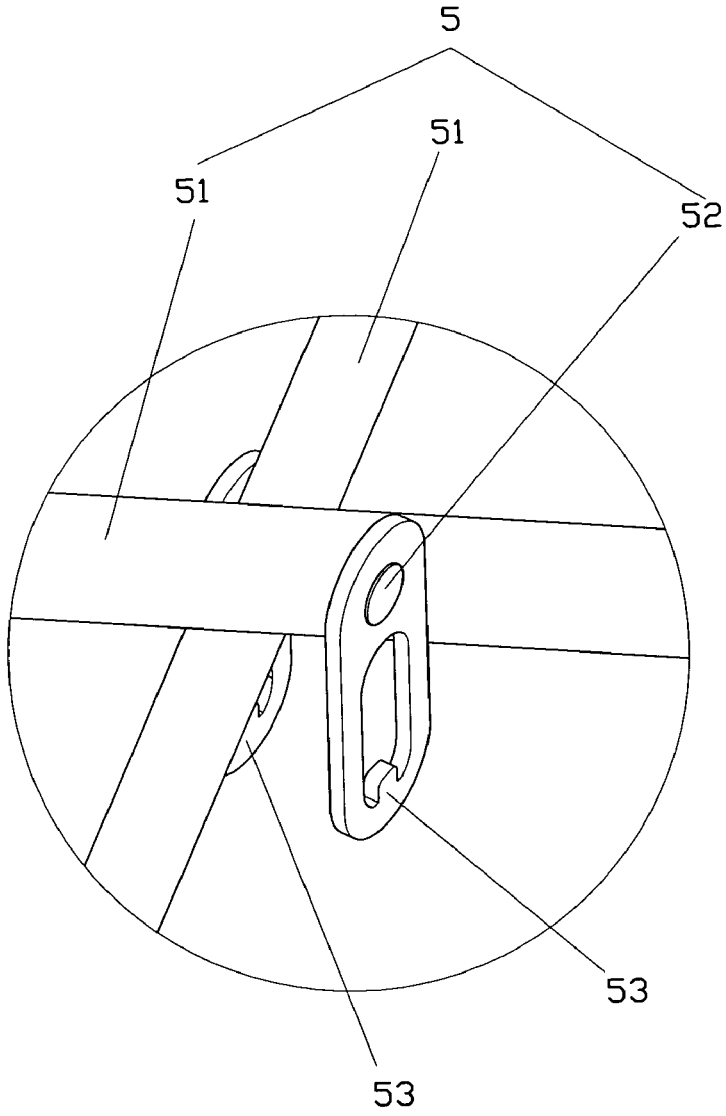
FIG. 5 is an enlarged view of a third linking rod set and hooks of the present invention.

There are two third linking rod sets 5. Each third linking rod set 5 is also formed by a pair of rods 51 and is connected in an X-shaped type. The connecting area of the two rods 51 has a third connecting end 52. The third connecting end 52 of the upper third linking rod set 5 is formed with hooks 53 at respective ends, as shown in FIG. 5. The four ends of the third linking rod set 5 are connected to the four first connecting ends 32 of the first linking rod sets 3, respectively.

Figure 6:
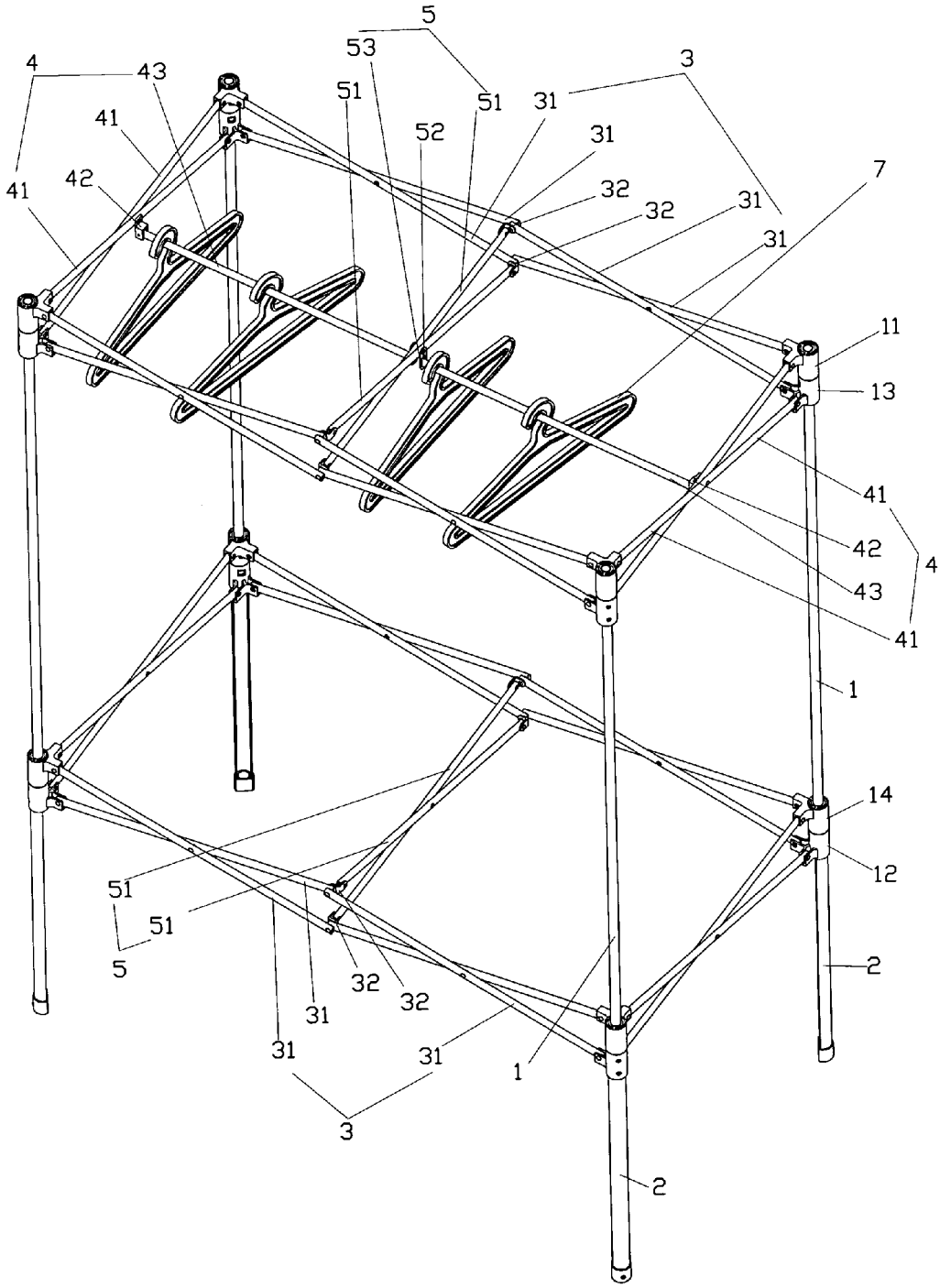
FIG. 6 is a perspective view of the present invention in an open status.
Figure 7:
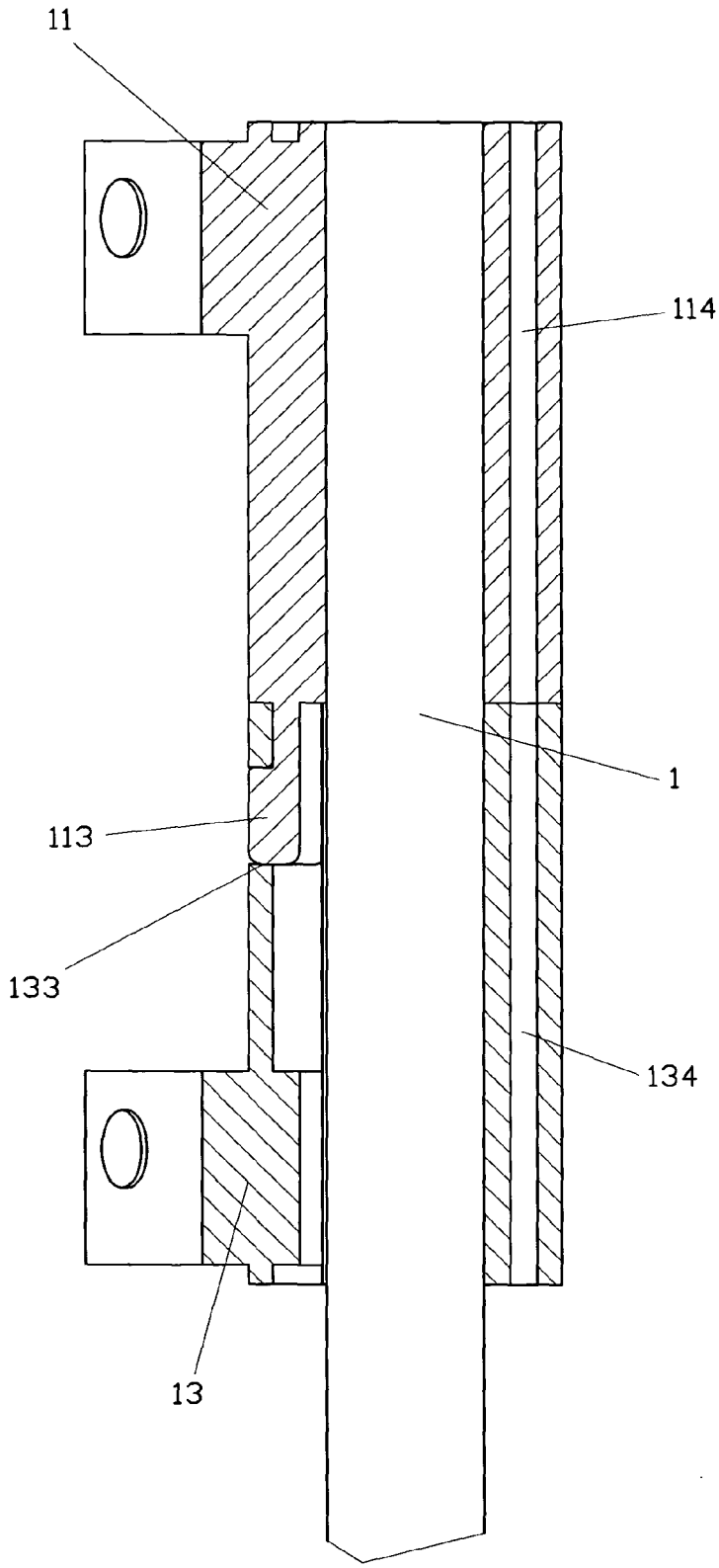
FIG. 7 is an enlarged cross sectional view of the first bracket and first sliding bracket of the present invention.
Figure 8:
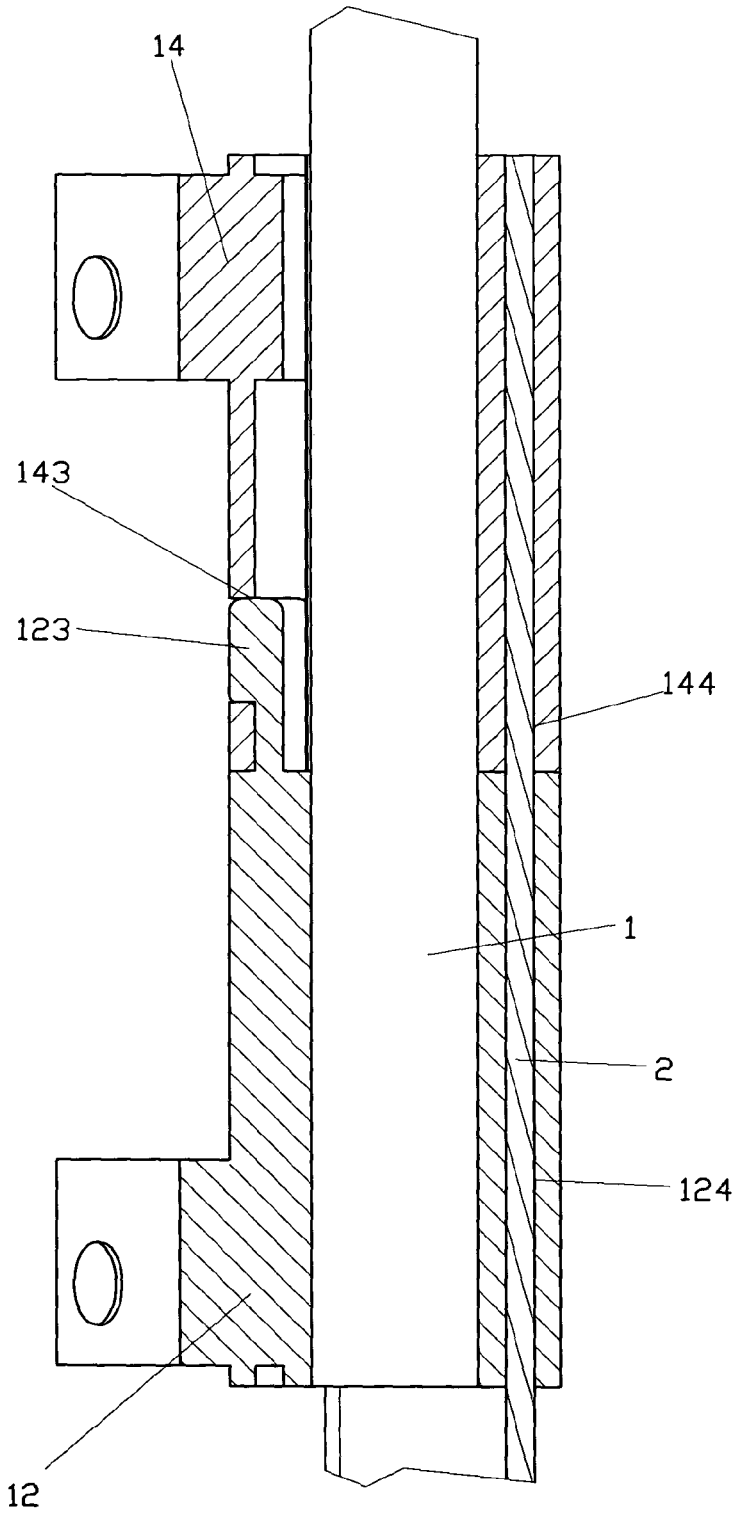
FIG. 8 is an enlarged cross sectional view of a second bracket and second sliding bracket of the present invention.
Figure 9:
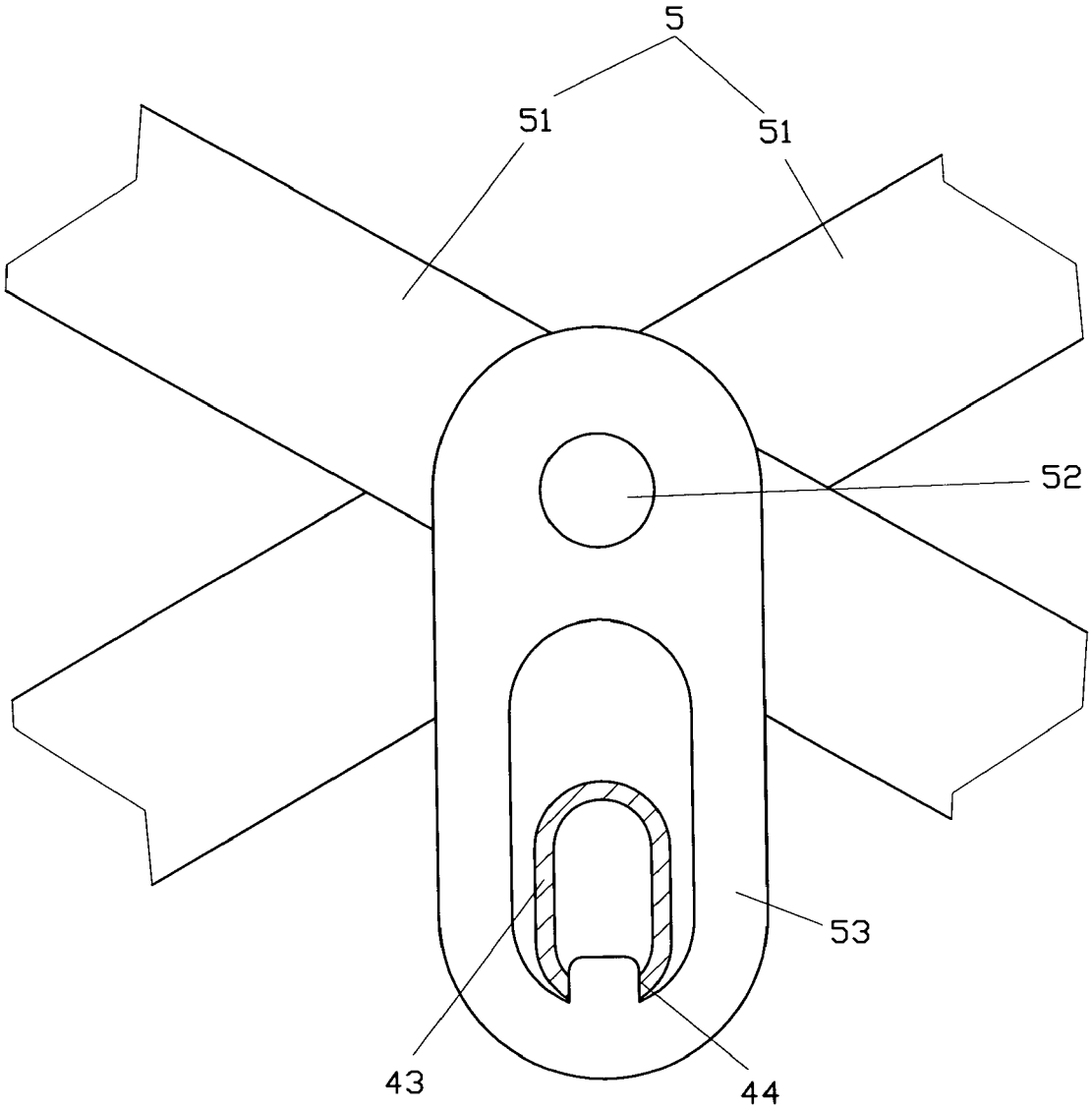
FIG. 9 is an enlarged view of a cross bar and a hook of the present invention.
Figure 10:
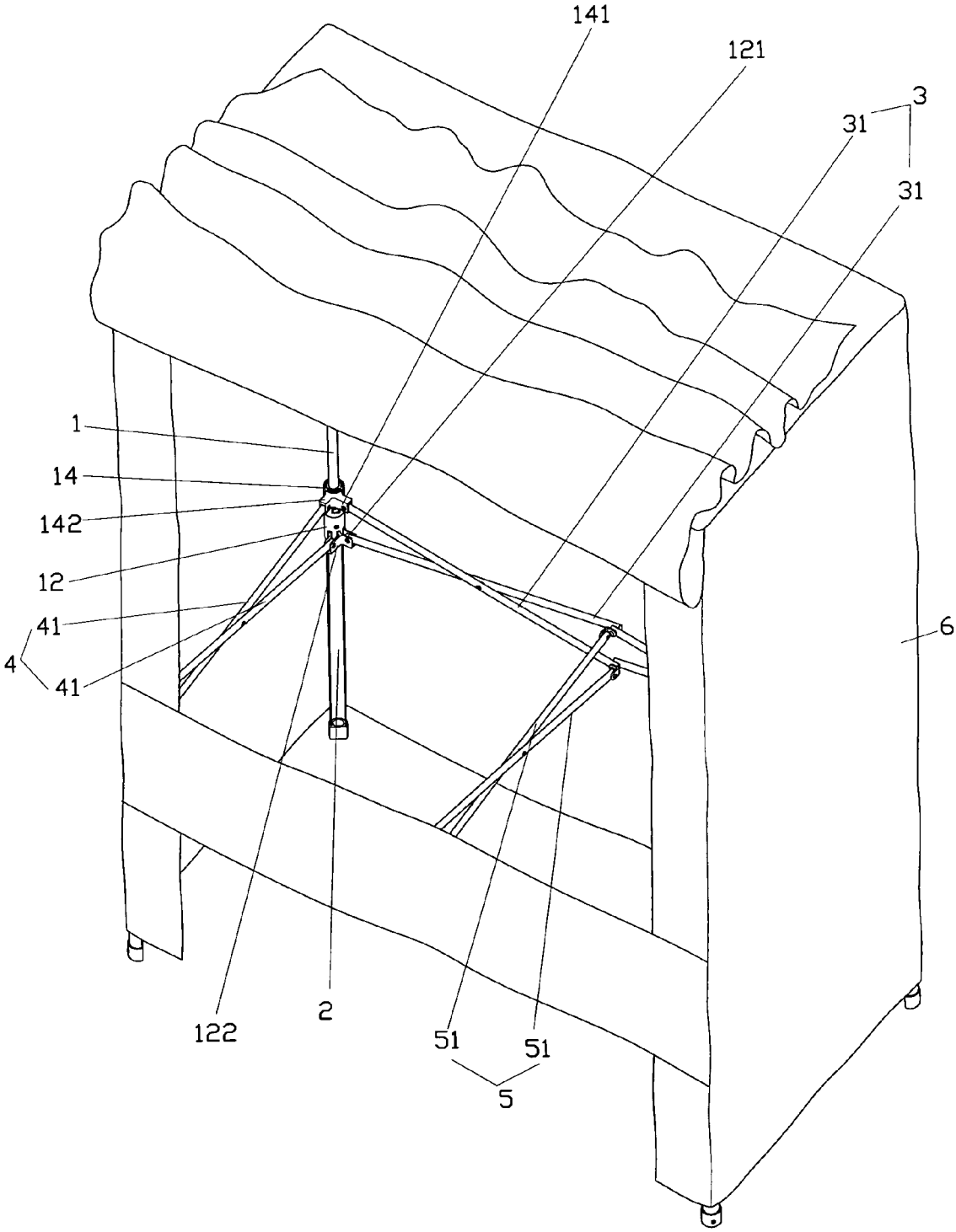
FIG. 10 is a perspective view of the present invention being covered with a cover.

In operation, as shown in FIG. 6, the four posts 2 are expanded outwardly at four corners, whereas the first sliding brackets 13 on the four pillars 1 will slide upward along the pillars 1 to the underneath of the first brackets 11, and the second brackets 12 link the pillars 1 to raise till the second brackets 12 has reached the underneath of the second sliding brackets 14, wherein the first linking rod sets 3, the second linking rod sets 4, and the third linking rod sets 5 are forced to expanded, as shown in FIGS. 7 and 8. That brings the clips 113 of the first brackets 11 and the clips 123 of the second brackets 12 into the holes 133 and 143 of the first sliding brackets 13 and the second sliding bracket 14, respectively. Thus the first linking rod sets 3, the second linking rod sets 4, and the third linking rod sets 5 are expanded entirely and prevent from sliding randomly. As shown in FIG. 9, the cross bars 43 of the second linking rod sets 4 have its holes 44 at the far ends hooked with the hooks 53 of the third linking rod set 5. The cross bars 43 are between the second linking rod sets 4 and the third linking rod set 5, so that clothes hangers 7 may be hanged on the cross bars 43. Place a cover 6 on the outside of the closet of the present invention, as shown in FIG. 10, and the present invention is completed with the assembly.

Figure 11:
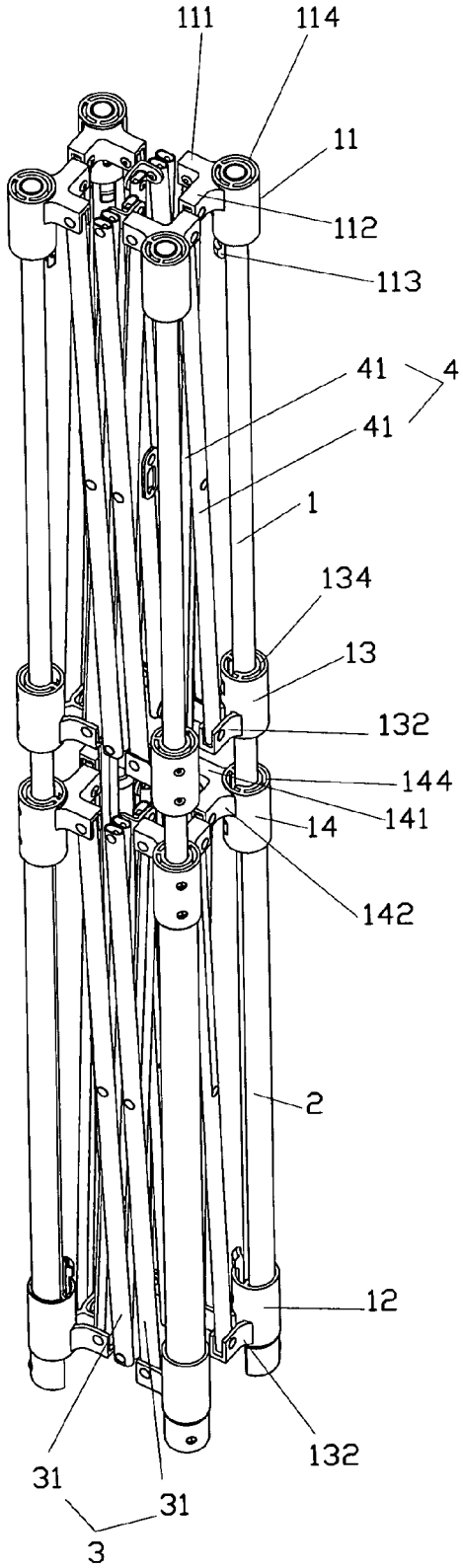
FIG. 11 is a perspective view of the present invention in a collapsed status.

To collapse the present invention, as shown in FIG. 11, simply take off the cover 6 and unhook the holes 44 of the cross bars 43 from the hooks 53, then disengage the clips 113 and 123 of the first brackets 11 and the second brackets 12 from the holes 133 and 143 of the first sliding brackets 13 and the second sliding brackets 14, push the pillars 1 towards each other, and the first sliding brackets 13 will slide along the pillars 1 downwardly, and the second brackets 12 will link the pillars 1 to move downward to the bottom ends of the posts 2. Whereas the first linking rod sets 3, the second linking rod sets 4, and the third linking rod sets 5 are collapsed. Upon the four posts 1 has reached to the centermost position, as shown in FIG. 11, the collapsible procedure is completed.

I claim:

1. A collapsible closet frame comprising posts, pillars, first linking rod sets, second linking rod sets, and third linking rod sets, wherein said pillars being located at four corners of said closet, each said pillar comprising a first bracket, a second bracket, a first sliding bracket and a second sliding bracket, wherein a top end of each said pillar being secured with said first bracket, a bottom end of each said pillar being secured with said second bracket, and said first sliding bracket and said second sliding bracket being sleeved on each said pillar between said first bracket and said second bracket;

each said post being inserted through said second bracket in a sliding manner while a top end of each said post being securely connected with said second sliding bracket;

each said first linking rod set comprising two rods connected at a center portion thereof to form an X-shaped member, two X-shaped members being connected to form a scissors-type structure, said scissors-type structure having a first connecting end at a center connecting area, and said first linking rod sets being connected with neighboring pillars;

each said second linking rod set comprising two crossed rods forming an X shape, said second linking rod set being connected to every two neighboring pillars different from said pillars being connected with said first linking rod set;

each said third linking rod set comprising two crossed rods forming an X shape, said two rods of said third linking rod set being connected with said first connecting end of said first linking rod set.

2. The collapsible closet frame, as recited in claim 1, wherein said second bracket of each said pillar comprises a groove for said post to slide through therein.

3. The collapsible closet frame, as recited in claim 1, wherein both said first bracket and said second bracket comprise clips thereon, and both said first sliding bracket and said second sliding bracket comprise holes thereon corresponding to said clips of said first bracket and said second bracket.

4. The collapsible closet frame, as recited in claim 1, wherein said first bracket, said second bracket, said first sliding bracket, and said second sliding bracket each comprises a first connecting end to be connected with said first linking rod set.

5. The collapsible closet frame, as recited in claim 1, wherein said first bracket, said second bracket, said first sliding bracket, and said second sliding bracket each comprises a second connecting end to be connected with said second linking rod set.

6. The collapsible closet frame, as recited in claim 1, wherein said second linking rod set comprises a second connecting end, said second connecting end comprises a cross bar having a hole thereon, and said third linking rod set comprises a third connecting end having hooks at both sides corresponding to said hole of said cross bar.

* * * * *